United States Patent [19]

Bouiller et al.

[11] Patent Number: 4,516,910

[45] Date of Patent: May 14, 1985

[54] RETRACTABLE DAMPING DEVICE FOR BLADES OF A TURBOJET

[75] Inventors: Jean G. Bouiller, Brunoy; Jean-Claude L. Delonge, Corbeil Essonnes; Marcel L. A. Rigo, Paray Vieille Poste; Didier G. Zietek, Seynod, all of France

[73] Assignee: S.N.E.C.M.A., Paris, France

[21] Appl. No.: 495,830

[22] Filed: May 18, 1983

[30] Foreign Application Priority Data

May 18, 1982 [FR] France ..... 82 08635

[51] Int. Cl.[3] ..... F01D 5/10; F01D 5/22

[52] U.S. Cl. ..... 416/190; 416/193 A; 416/500

[58] Field of Search ..... 416/144, 145, 220 R, 416/95, 190, 193 A, 196 R, 500 (U.S. only)

[56] References Cited

U.S. PATENT DOCUMENTS

| | | | |
|---|---|---|---|
| 3,112,915 | 12/1963 | Morris | 416/220 X |
| 3,266,771 | 8/1966 | Morley | 416/196 X |
| 3,318,573 | 5/1967 | Matsuki et al. | 416/95 X |
| 3,709,631 | 1/1973 | Karstensen et al. | 416/220 X |
| 3,972,645 | 8/1976 | Kasprow | 416/193 A |
| 4,101,245 | 7/1978 | Hess et al. | 416/190 |
| 4,177,013 | 12/1979 | Patterson et al. | 416/190 X |
| 4,182,598 | 1/1980 | Nelson | 416/193 A |
| 4,183,720 | 1/1980 | Brantley | 416/193 A |

FOREIGN PATENT DOCUMENTS

| | | | |
|---|---|---|---|
| 989556 | 9/1951 | France | 416/215 |
| 2658345 | 6/1978 | France | 416/193 A |
| 2376958 | 8/1978 | France . | |
| 670665 | 4/1952 | United Kingdom . | |
| 1259750 | 1/1972 | United Kingdom | 416/193 A |
| 2062119 | 5/1981 | United Kingdom . | |

*Primary Examiner*—Everette A. Powell, Jr.
*Attorney, Agent, or Firm*—Oblon, Fisher, Spivak, McClelland & Maier

[57] ABSTRACT

A retractable damping device for the blades of a turbojet, located between two consecutive blades against the lower face of the platforms of said blades. The damping element, mounted to rotate by one of its ends in the middle part of the space formed between the blades and a rotor disk positioned along an axis perpendicular to a radial axis of the disk, exhibits an upper part which constitutes a projecting dihedral that takes the form of the protruding dihedral consisting of the platforms of the two consecutive blades under the action of centrifugal force.

4 Claims, 5 Drawing Figures

RETRACTABLE DAMPING DEVICE FOR BLADES OF A TURBOJET

BACKGROUND OF THE INVENTION

1. Field of the Invention

This invention has as its object a retractable damping device for the blades of a turbojet.

2. Description of the Prior Art

To limit the amplitude of the vibrations of the blades of a turbojet during its operation, it is known how to use various devices for damping vibrations of the blades. From another point of view, that of maintenance, it is desirable to be able to remove the blades separately and it is therefore necessary that the damping element not be an obstacle during removal of the blades.

A device is known in which the damping element is mounted at a right angle between the upstream face of the rim of the rotor disk and a flange. However, the right angle of this damping element exhibits a critical bending zone. It is also known how to use other damping devices, but none of which are entirely satisfactory.

SUMMARY OF THE INVENTION

According to this invention, the damping element is placed between two consecutive blades against the lower face of the platforms and such is noteworthy in that one of its ends which is placed in the middle part of the space between the blades and a rotor disk, being able to rotate around a geometric axis perpendicular to a radial axis of the rotor disk and in the plane of the disk, exhibits an upper part shaped to constitute a projecting dihedral that takes the form, under the action of the centrifugal force, of the dihedral protruding into the platforms of the two consecutive blades.

This arrangement allows for the damping element to pass under the shanks of the blade during blade by blade mounting or removal. Moreover, it is better positioned between the blades shanks that jamming does not occur. To optimize its resistance energy under the platforms of the blades, the support surface of the damping elements is larger because it extends under the common platforms of two blades.

According to an embodiment of the invention, the damping element is mounted to rotate around one of its ends which exhibits a cylindrical boss engaged in a housing with a cylindrical bottom made between two projections formed in the middle part of a tooth of the support.

This arrangement exhibits the advantage of simplicity of the mechanism and of using gravity to keep the damping element of the blades situated in the upper part in a retracted position, and to allow unitary removal of said blades.

According to another embodiment of the invention, the damping element is subjected to the action of an elastic element maintaining said damping element in contact with the lower face of the platforms of the blades. This arrangement uses the presence of the tip flange of the blade to retain the damping element axially. Because of this, the damper is positioned in the cavity formed by a tooth of the disk, the shanks and the platforms of two consecutive blades.

To prevent the damping element from beating, at low speed, or from taking an incorrect position, such is associated with an elastic element which flattens said element on the lower face of the wings of two consecutive platforms and which participates in the mounting sequence.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
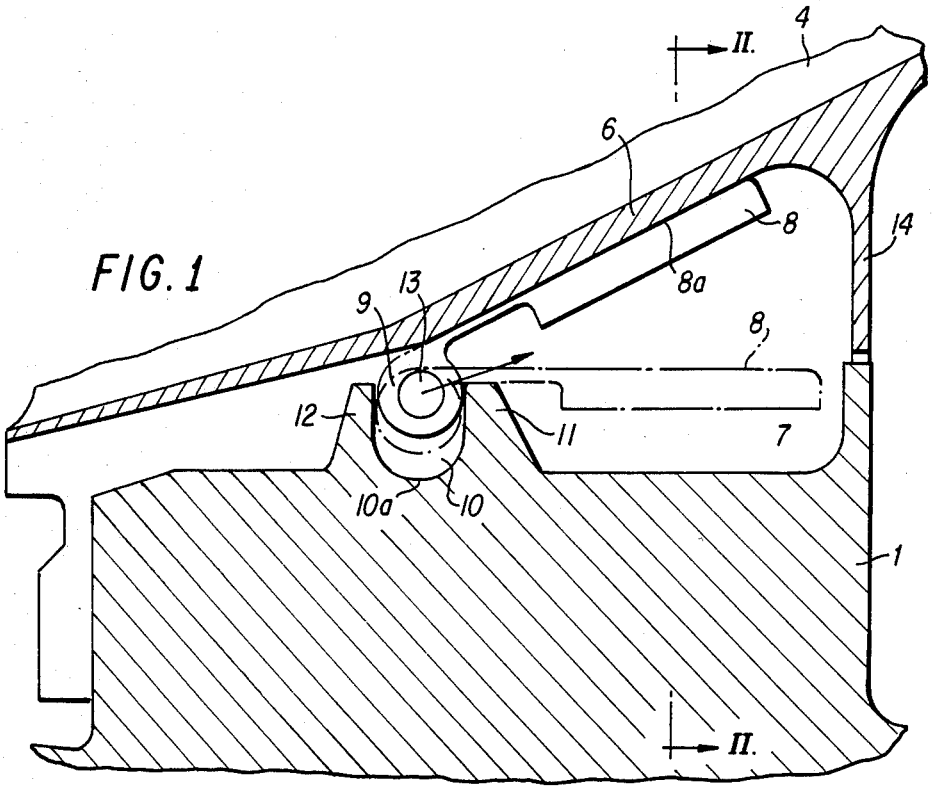
FIG. 1 is a partial axis sectional view of a blade and a support disk of the blades, having a damping device according to the invention.
Figure 2:
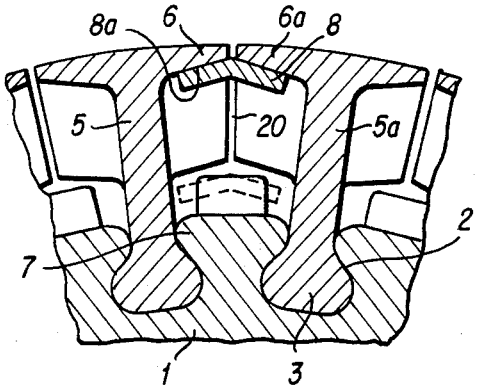
FIG. 2 is a sectional view taken along line II—II of FIG. 1.

In FIGS. 1 and 2, there is represented a rotor disk 1 exhibiting grooves 2 in which are mounted the feet 3 of blades 4. In the space delimited by flanges 5, 5*a* and platforms 6, 6*a* of two consecutive blades 4 and a tooth portion 7 of disk 1 is placed an element 8 for damping the vibrations of blades 4.

Damping element 8 consists of a small plate exhibiting an upper part 8*a* made to constitute a projecting dihedral that takes the form, under the action of the centrifugal force, of the dihedral protruding into platforms 6, 6*a* of two consecutive blades 4. Damping element 8 is mounted to rotate by one end portion thereof in the middle part of the space between blades 4 and rotor disk 1, along an axis perpendicular to a radial axis of the rotor disk 1.

For this purpose, damping element 8 exhibits at one of its ends a cylindrical boss 9 engaged in a groove 10 whose bottom 10*a* is cylindrical and which is formed between two projections 11 and 12 formed in the middle part of tooth portion 7 of rotor disk 1. The forward projection 12 prevents boss 9 from sliding forward when the engine is stopped. Rear projection 11 supports the axial load, represented by an arrow in FIG. 1, due to the centrifugal force of the damping element and with this in view, such is therefore strengthened.

To prevent any jamming, a considerable clearance is provided between cylindrical boss 9 of the damping element 8 and its housing between projections 11 and 12.

If the imbalance created by the weight differences are too large, it is possible to mill the plane surface of the rectangular portion of the damping element 8. Moreover, a hole 13 drilled in cylindrical boss 9 makes it possible to position the center of gravity at the greatest possible diameter, therefore the farthest possible from the tooth portion 7 of the disk 1.

When the engine is operating damping element 8 is flattened under the action of centrifugal force against platforms 6, 6*a* of the blades in such a way that upper part 8*a* of said element 8, in the shape of a projecting dihedral, takes the form of the protruding dihedral consisting of platforms 6, 6*a* of two consecutive blades 4, 4.

When the engine is stopped regarding the blades 4 situated in the upper part of the disk 1, damping element 8 occupies the position represented by a broken line in FIGS. 1 and 2, under the action of gravity. In this position, it is easy to mount and remove one of blades 4 whose tip flange 14 can pass over the damping element 8 in a retracted position.

Figure 3:
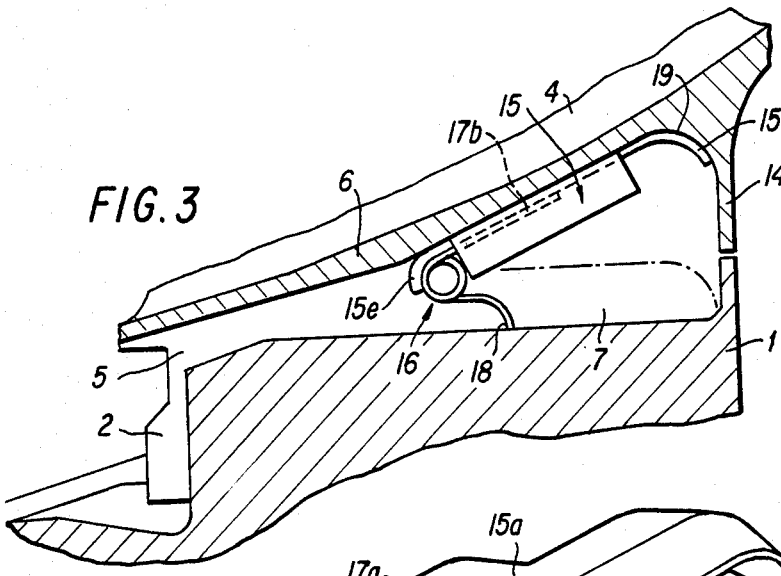
FIG. 3 is a partial axis, sectional view of a blade according to another embodiment of the damping device.
Figure 4:
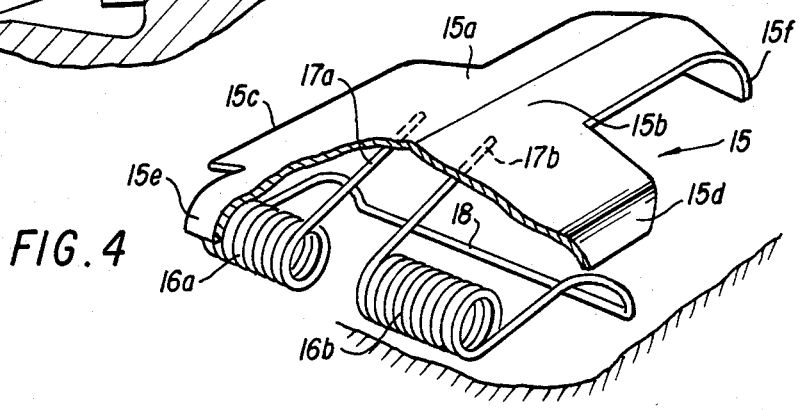
FIG. 4 is a view in perspective of the damping device represented in FIG. 3.
Figure 5:
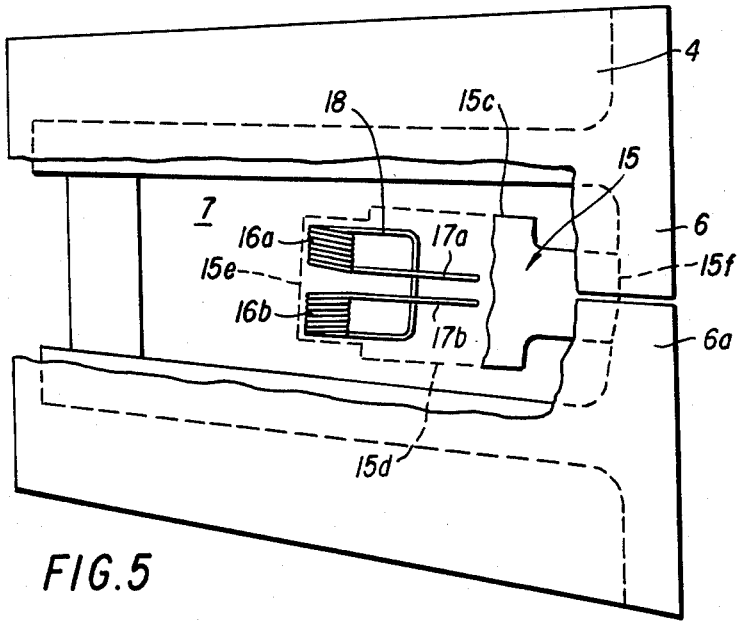
FIG. 5 is a plan view of two blades with a cutaway portion showing the damping device of FIG. 3.

Another embodiment of the damping device represented in FIGS. 3, 4 and 5 consists of a damping element 15 of sheet metal cut in the shape of a cross and then folded lengthwise to constitute a projecting dihedral formed from faces 15*a*, 15*b* and whose four edges 15*c*, 15*d*, 15*e*, 15*f* and further folded in the shape of a trough. Forward face 15*a* receives in a concave part thereof a torsion helical spring 16 which consists of two parts 16*a*, 16*b* whose free ends 17*a*, 17*b* are attached, particularly by welding, on the inner face of damping element 15, said parts 16*a*, 16*b* of the helical spring being connected by a loop 18 resting against rotor disk 1.

Modifications can be made to this embodiment illustrated by way of example. Thus, the supports of the helical spring 16 can be inverted, branches 17*a* and 17*b* then being at a greater distance than loop 18. Thus, the helical spring 16 could also be replaced with a leaf spring.

When the damping element 15 is in place in the housing delimited by a tooth portion of disk 1, flange 5 and platforms 6, 6*a*, of two consecutive blades 4, its faces 15*a*, 15*b* forming a projecting dihedral, are supported under the action of spring 16 against the lower faces in the shape of a dihedral angle of platforms 6, 6*a* of the blades 4. Rear edge 15*f* in the shape of a trough is fitted to a curved portion 19 of the rear shroud 14 of blade 4.

During high speed operation, damping element 15 is flattened by centrifugal force under platforms 6, 6*a* of the blades 4, spring 16 no longer being flattened against tooth portion 7 of disk 1 and the damping being accomplished by friction. At low speeds, spring 16 maintains damping element 15 in contact with platforms 6, 6*a* and prevents the blade 4 from vibrating at low rotation speeds.

The ribs formed by four edges 15*c*, 15*d*, 15*e*, 15*f* provide rigidity which opposes buckling of the part. During stopping, spring 16 assures positioning of the damping element 15 under platforms 6, 6*a* of the blades 4.

To mount blade 4, the blade is inserted by the front via its flange 2. Then, a damping element 15 is jammed into the rear part of a lateral groove portion of the blade.

The adjacent blade 4 is introduced and as tip flange 14 of this second blade progresses to the rear of the disk 1, it compresses spring 16 of damping element 15 and the spring is then released when tip flange 14 of the blade 4 is perpendicular with the rear projection of disk 1, and being almost totally released, flattens the damping element 15 against portions of the two adjacent platforms 6, 6*a*.

Because of its dihedral shape, the damping element 15 is automatically positioned in the dihedral formed by the two platforms 6, 6*a*.

To remove a blade 4, it is necessary to compress spring 16 of the damping element 15, either by pulling the damping element 15 from the front using special pliers, or by pressing on damping element 15 using a blade radially introduced into clearance 20 existing between two platforms 6, 6*a*, (see FIG. 2).

This arrangement can also be used to dampen the vibrations of stator vanes but, in this case, the rigidity of the spring must be greater.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A turbojet rotor assembly comprising:

a rotor disk having a rotational axis;

a plurality of blades mounted in a rim of said disk, each of said blades having a platform, platforms of adjacent ones of said blades defining a dihedral, and a space defined between each said dihedral and said desk rim;

a damping element in each said space, each said damping element having an upper part forming a projecting dihedral whose shape corresponds to said dihedral defined by said platforms, each said damping element further comprising means for pivoting said upper part about an axis extending transverse to said rim axis and in a plane of said disk; and an elastic element for elastically biasing said damping element to pivot said upper part such that said projecting dihedral contacts and presses against said dihedral defined by said platforms.

2. The assembly of claim 1, wherein said elastic element comprises a helical spring having first and second parts having free ends which contact said damping element and which includes a loop portion connecting the first and second parts and which contacts said rotor disk.

3. The assembly of claim 1, wherein said elastic element comprises a leaf spring.

4. The assembly of claim 1, wherein each of said blades further comprises a tip flange having a curved surface and wherein said damping element further comprises a folded sheet member having a rear edge which fits said curved surface of the tip flange of the blade.

* * * * *

UNITED STATES PATENT AND TRADEMARK OFFICE

CERTIFICATE OF CORRECTION

PATENT NO. : 4,516,910

DATED : May 14, 1985

INVENTOR(S) : BOUILLER ET AL

It is certified that error appears in the above-identified patent and that said Letters Patent is hereby corrected as shown below:

Column 1, line 40, change "that" to --so that--.

Column 2, line 68, change "blades 4, 4" to --blades 4--.

Column 3, line 33, change "shroud" to --tip flange--.

Signed and Sealed this

*Twenty-fourth* Day of *September 1985*

[SEAL]

*Attest:*

*Attesting Officer*

DONALD J. QUIGG

*Commissioner of Patents and Trademarks—Designate*